US005802972A

United States Patent [19]

Hoffmann et al.

[11] Patent Number: 5,802,972

[45] Date of Patent: Sep. 8, 1998

[54] TAMPON PRINTING PROCESS

[75] Inventors: Hans-Rainer Hoffmann, Neuwied; Bodo Asmussen, Ammersbek; Klaus Schumann; Walter Müller, both of Neuwied, all of Germany

[73] Assignee: LTS Lohman Therapie-Systeme GmbH & Co., KG, Neuwied, Germany

[21] Appl. No.: 966,792

[22] Filed: Nov. 10, 1997

Related U.S. Application Data

[63] Continuation of Ser. No. 492,054, filed as PCT/EP94/00051 Jan. 10, 1994 published as WO94/16894 Aug. 4, 1994, abandoned.

[30] Foreign Application Priority Data

Jan. 29, 1993 [DE] Germany ..... 43 02 445.9

[51] Int. Cl.[6] ..... B41M 1/10

[52] U.S. Cl. ..... 101/170; 101/163

[58] Field of Search ..... 101/114, 119, 101/120, 129, 41, 42, 43, 44, 163, 170, 366, 477

[56] References Cited

U.S. PATENT DOCUMENTS

| | | | |
|---|---|---|---|
| 3,009,415 | 11/1961 | Harvey | 101/163 |
| 3,949,667 | 4/1976 | Zimmer | 101/119 |
| 3,974,767 | 8/1976 | Hagelberg | 101/163 |
| 4,033,258 | 7/1977 | Farrow | 101/170 |
| 4,103,614 | 8/1978 | Mitter | 101/119 |
| 4,116,124 | 9/1978 | Farrow et al. | 101/163 |
| 4,409,924 | 10/1983 | Lavertz et al. | 101/129 |

FOREIGN PATENT DOCUMENTS

| | | |
|---|---|---|
| 623 597 | 3/1989 | Australia . |
| 1 949 437 | 2/1971 | Germany . |

*Primary Examiner*—Ren Yan

*Attorney, Agent, or Firm*—Wenderoth, Lind & Ponack, L.L.P.

[57] ABSTRACT

A tampon printing process which uses a printing plate having at least one printing form at its surface, wherein the printing form is filled with printing medium at time intervals and the printing medium is subsequently transferred from the printing form onto a support by means of a tampon.

10 Claims, 2 Drawing Sheets

TAMPON PRINTING PROCESS

This application is a continuation of now abandoned application Ser. No. 08/492,054, filed Sep. 28, 1995, which application is a National Stage application of International Application No. PCT/EP94/00051, filed Jan. 10, 1994.

The present invention relates to a tampon printing process which uses a printing plate having at least one printing form at its surface. The printing form is filled with printing medium at time intervals, and the printing medium is transferred from the printing form to a support by means of a tampon.

BACKGROUND OF THE INVENTION

Tampon printing processes as a special kind of rotogravure process have been known for some time. The image to be printed is sunk, etched or engraved as negative in the printing form of a printing plate. The negative in the printing plate may also be created by means of electroerosion. A transfer body, the so-called tampon, usually based on silicone rubber, takes up the printing medium left in the grooves or holes of the printing form after wiping off and transfers the print image onto the support or object to be inscribed or decorated. Such a tampon printing device is described, for example, in DE-OS 19 39 437.

However, the known technique of tampon printing has some drawbacks which mainly relate to the precise metering of printing medium into the printing form, e.g., by means of a metering pot located at the top. Lately however, this exactness has gained in importance since, according to DE-OS 37 27 232, the tampon printing process is used for dosing medicinal agents.

The following deficiencies were discovered:

- subsequent dripping from the metering pot, which is used to apply the metering medium, during its motion relative to the printing form,
- undesired temperature changes of the printing medium during the relative motion between metering pot and metering form or printing plate, respectively,
- undesired inclusion of air on contact of the empty printing form with the metering pot, and
- delays caused by the relative motion of the metering pot to the printing plate.

DESCRIPTION OF THE INVENTION

It is the object of the present invention to overcome the above disadvantages, technical limits and difficulties by improving the previous tampon printing processes and to provide a tampon printing process which allows high accuracy, in particular when medicinal agents are metered, and an increased production rate at high precision.

To solve this problem the present invention proposes in a tampon printing process of the present kind, to fill the printing form with a printing medium from the bottom by means of feed channels connecting the printing form with a printing medium storage unit and passing the printing plate from below.

As a result the printing medium advantageously flows through the feed channels, which pass the printing plate from below, and directly flows into the bottom of the printing form. To this end, the channels are distributed over the bottom area of the printing form at an adequate number of places the channels and are shaped in a geometrically suitable manner, whereby round, square, slot or sieve-like openings ensure an even distribution of printing medium on the bottom of the printing form. The filling is controlled by an intermittent pressure acting on the printing medium, whereby the dosage of the amount of printing medium to be supplied into the printing form is controlled by the duration of the feed pressure and/or the intensity of the feed pressure.

Another possibility is to transport the printing medium into the printing form by means of a volumetric metering device, such as a piston pump or hose pump. The advantage of this alternative is the fact that filling the printing form is independent of the viscosity of the printing medium to a large extent.

Prior to entering the feeding channels the printing medium is advantageously passed through a collecting chamber to even out the pressure and is then supplied from this chamber into the individual feed channels. In this connection it may be useful to form the individual channels with different flow areas and/or extensions in order to create different flow resistances on passage of the printing medium through the individual channels. In addition, the new tampon printing process allows the printing form to be filled with printing medium at temperatures other than room temperature, preferably at elevated temperatures. The temperature level desired for the filling process may be adjusted by means of heating elements located in the printing form and/or in the preceding chamber. This may, for example, be caused by the necessity to influence the viscosity of the printing medium.

A very advantageous tampon printing process, wherein the printing form is filled with printing medium at repeated time intervals within a sequence of working cycles, results according to the present invention by the fact that the support is led over the printing form in the form of a tape intermittently under tension and at a small distance. During each filling phase of the printing form, the tape is conveyed by one grid distance and stopped for one printing being pressed against the printing form by means of a tampon; then the tampon is lifted and the tape lifted off the printing form and conveyed by one grid distance. During this procedure the printing form is filled with printing medium from below for the subsequent operating cycle. In this manner the tampon is kept free from printing medium and clean so that smudged print images are completely avoided. In this tampon printing process the whole motion travel relates to the transport of the supporting web and to a straight upstroke and downstroke of the tampon, as well as to the supply of printing medium from the bottom, which may be effected, for example, by a displacer similar to that of a fuel injection pump. An air jet may, for example, be used to lift off the tape from the print image, simultaneously to the lifting of the tampon.

The present invention will be demonstrated by the drawings showing illustrative embodiments; further details and advantages can be seen from these drawings in which FIG. 1 is a sectional drawing of a printing form provided with a collecting chamber for bottom feed by means of feeding channels;

Figure 1:
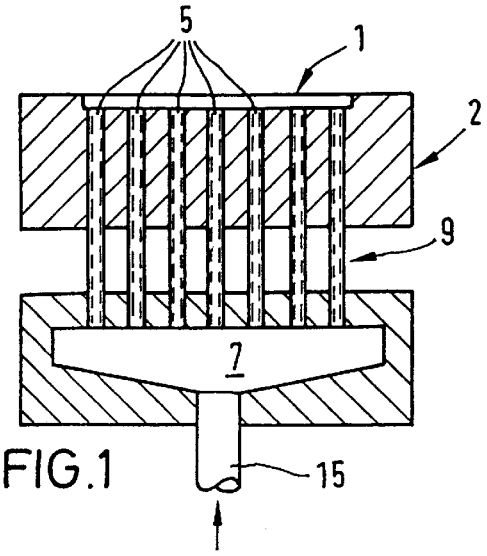

FIG. 1 shows a printing form 1 which is incorporated in a printing plate 2; the feed channels 9 ending in the bottom of the printing form 1 are connected with a collecting chamber 7. The collecting chamber 7 serves to even out the feed pressure for the printing medium which is transported under pressure from a printing medium storage tank (not shown) through the feeding conduct 15. It can be seen that the printing form 1 is filled with printing medium from the bottom with great advantage by supplying the printing medium from below from the pipe 15 via the collecting chamber 7 and through the variety of channels 9. The channels 9 pass through the printing plate 2.

Figure 2:
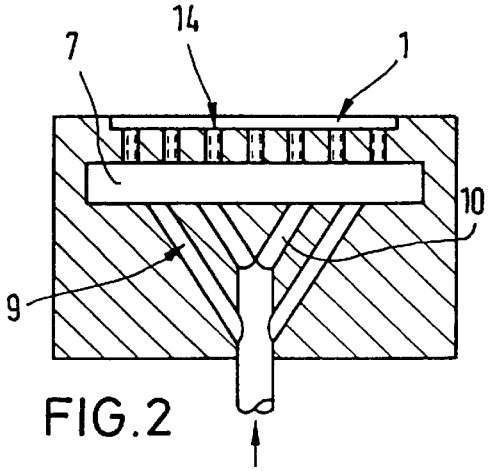
FIG. 2 is a sectional drawing through the bottom of another printing form.
Figure 4:
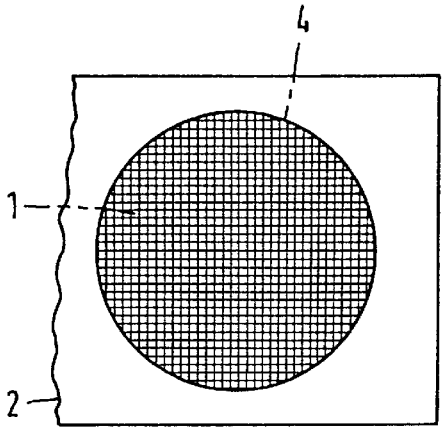
FIG. 4 is a plan view of another printing form having a bottom formed like a sieve.

FIG. 2 illustrates another embodiment of the feeding channels 9 having branches 10, a collecting chamber 7 and opening regions 14 in the bottom of the printing form 1. The channels 9 may, for example, be tubes of a small diameter suitably ending as a screen plate 4, whereby the printing medium is evenly distributed over the area of the printing form through the multitude of pores 4; this is shown in FIG. 4 in plan view.

Figure 3:
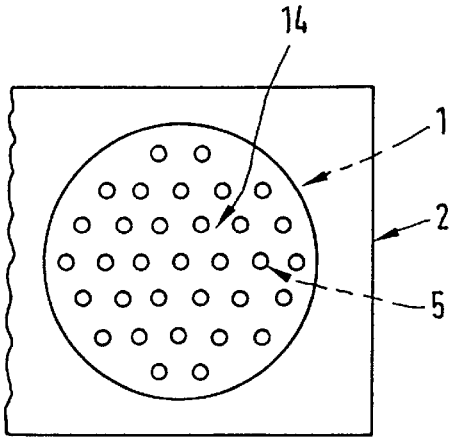
FIG. 3 is a plan view of a printing form with channel openings geometrically distributed in the bottom.

The plan view on a part of the printing plate 2 with a printing form 1 (FIG. 3) shows a variety of openings 5 of individual channels 9 which are geometrically distributed over the area of printing form 1 in the bottom or in the end region of channels 9 in the bottom of the printing form 1.

Figure 5:
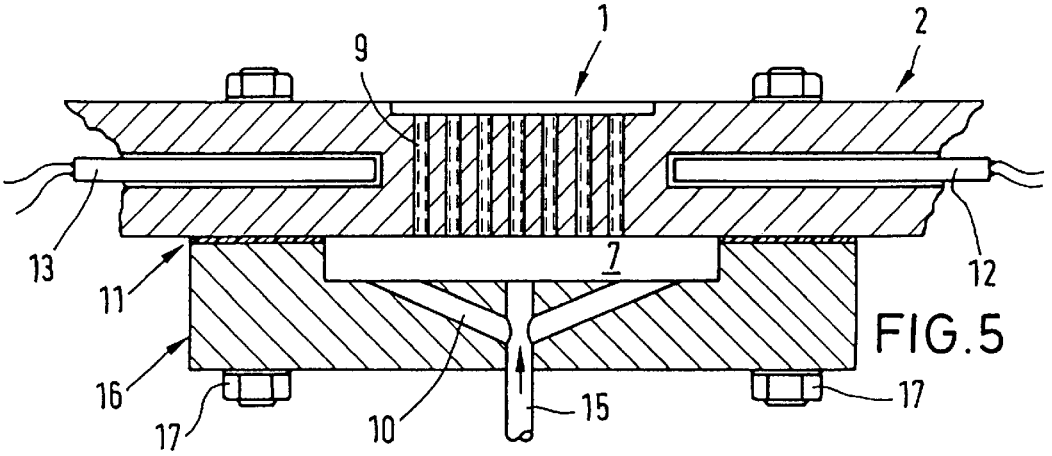
FIG. 5 is a sectional drawing of a printing form provided with heating elements.

FIG. 5 shows a cross section through a part of a printing plate 2 with a bottom of printing form 1 provided with passages. The printing form 1 can be filled with printing medium from below via a collecting chamber 7. The attachment 16 forming the collecting chamber 7 is connected to the printing plate 2 by means of a seal 11 and threaded joints 17. The printing plate 2 is provided with heating elements 12 and 13 by means of which the printing plate may be heat-regulated.

Wiping-off which is necessary when the printing form is filled from the top and the disadvantages relating thereto are advantageously avoided by the process according to the present invention.

Metering the printing medium—in particular if an active substance-containing medium is concerned—can be effected with the highest possible precision; in addition, due to significantly shorter cycle times, a considerable increase of productivity resulting in a reduction of production costs can be achieved. Until today it has not been possible to achieve short cycle times—as are feasible now by the present invention—because of the required mechanical operating motion of the parts of the device.

The process can be used with advantage in transfer operations by which flowable media are to be transferred to a substrate used as support by means of a phased and defined dosage from a storage vessel.

Figure 6:
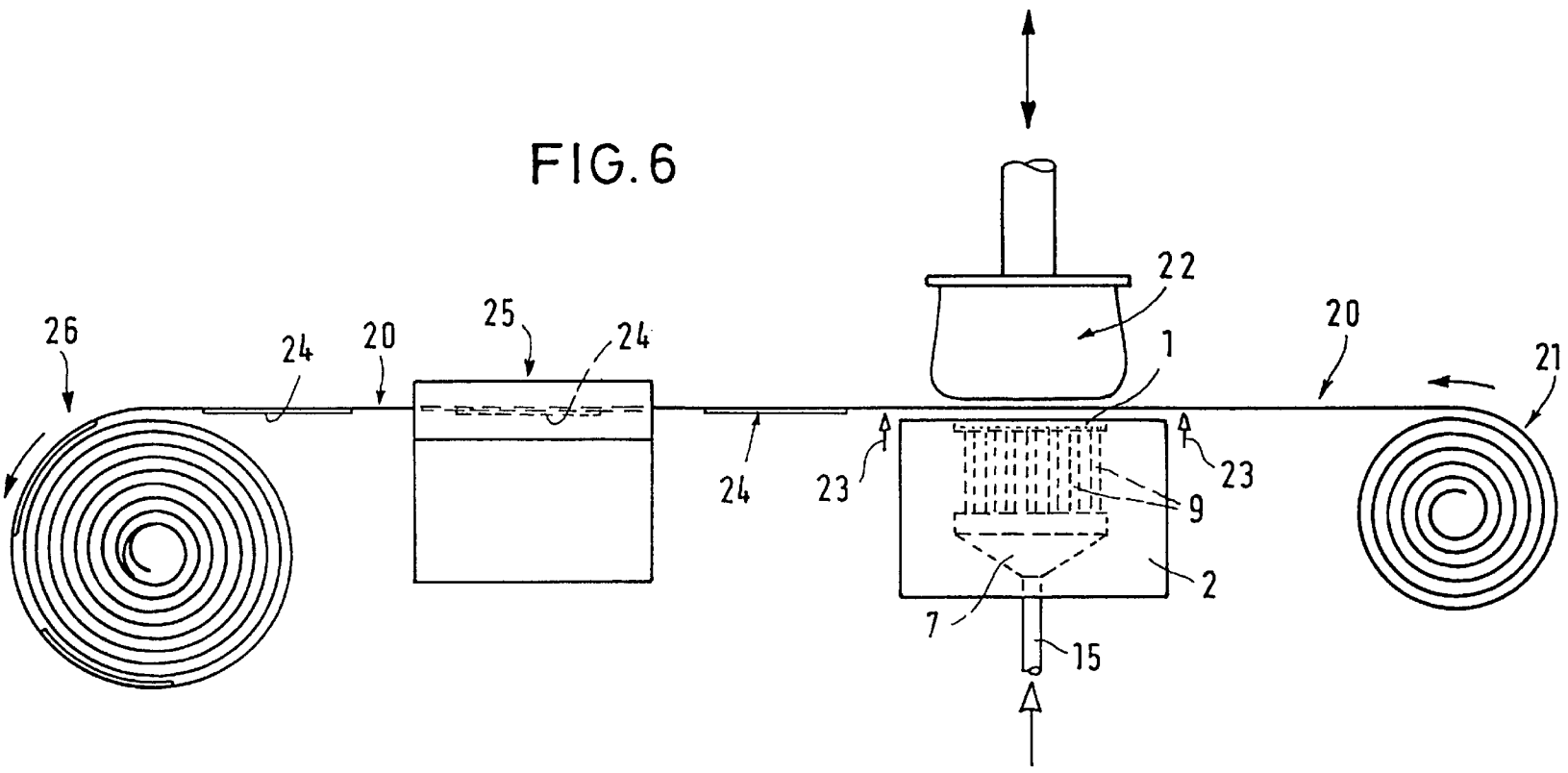
FIG. 6 is a schematic flowsheet of a printing process according to the present invention.

A very convenient printing process possible by means of the present invention is represented in FIG. 6 as purely schematic flowsheet. A support 20 is printed with a medium which is supplied into the printing form 1 of the printing plate 2 from a storage vessel (not shown) by means of a geometrical pressure feeding device (not shown) through the supply pipe 15 via the collecting chamber 7 in the manner shown in FIGS. 1 to 5. The support 20 in the form of a tape is unwound from a supply reel 21 under tension, intermittently passed over the printing form 1 at a small distance and transported by one grid distance during each filling phase of the printing form 1. Below the tampon 22, which is lifted during conveyance, the tape 20 is stopped for one printing operation and pressed against the printing form by the tampon 22. In this manner the print image is transferred or printed from the printing form 1 to the support 20. Immediately after that, the tampon 22 is lifted and the web taken off the printing form 1 and conveyed by one grid distance. In the course of this procedure the printing form 1 is filled with printing medium from below for the next printing operation. Lifting-off the printed tape 20 from the printing form 1 may, for example, be effected by means of nozzles 23.

Now, the underside of the stretched tape is provided with printed images 24 which have to be dried. For this purpose, a drying station 25 may be located at a distance from the printing station. Here the new print image is dried by known means, e.g. in a hot-air-tunnel. Subsequently, the printed support can be wound onto a take-up reel 26. Instead of the take-up unit, finishing devices may be provided.

It is understood that the present invention shall not be limited to the embodiments demonstrated in the examples. For example, the devices may be formed for the use in multiple printing, printing forms may be formed by etching, engraving, electroerosion, and the feeding channels in the bottom of a printing form 1 may be arranged in any desired distribution. The new printing process according to the present invention offers new and economical ways for an accurate dosage, in particular of medicinal agents, using extremely economical means and operating methods. In this respect the present invention represents an optimum solution of the object given in the beginning of this description.

We claim:

1. In a printing process which comprises feeding a printing medium to at least one printing form of a printing plate, said printing plate being provided at its surface with said printing form, supplying said printing form with printing medium at time intervals and subsequently transferring the said printing medium to a support, the improvement wherein the process is a tampon printing process in which precisely regulated quantities of printing fluid are transferred onto a support by causing a tampon to press said support against the printing form and wherein the supply of printing fluid is conveyed from a storage vessel into the printing form from below, passing through the printing plate, by means of a plurality of channels which emerge at the bottom of the printing form.

2. A process according to claim 1 wherein the printing fluid is conveyed by application of intermittent pressure.

3. A process according to claim 1 wherein the channels emerge at the bottom of the printing form with round, square, slot or sieve-like, cross sections.

4. A process according to claim 3 wherein the amount of the printing fluid to be supplied to the printing form is metered by at least one of the length of the feed phase and the intensity of the feed pressure.

5. A process according to claim 3 wherein the printing fluid being fed to the printing form is metered volumetrically.

6. A process according to claim 3 wherein the printing fluid before entering the channels, is passed through a collecting chamber connecting said channels.

7. A process according to claim 6 wherein the individual channels are assigned different flow resistances for the printing fluid.

8. A process according to claim 1 wherein the printing fluid is introduced in the printing form at an elevated temperature.

9. A process according to claim 1 wherein in a sequence of printing operations the support is passed intermittently over the printing form under tension and at a small distance and, in this process, is advanced by one grid distance during each filling of the printing form with printing fluid, and is then stopped for the duration of one print operation while being pressed against the printing form by the tampon whereinafter the tampon and the support are simultaneously lifted from the printing form and advanced by one grid distance, during which process the printing form is supplied with printing fluid for the following printing operation.

10. A process according to claim 9 wherein the support is in the form of a tape.

* * * * *